US008746347B2

(12) United States Patent
Willoughby

(10) Patent No.: US 8,746,347 B2
(45) Date of Patent: Jun. 10, 2014

(54) SUBSEA WELLHEAD PROVIDING CONTROLLED ACCESS TO A CASING ANNULUS

(75) Inventor: Daniel A Willoughby, Uig (GB)

(73) Assignee: Aker Subsea Limited, Maidenhead, Berkshire (GB)

( * ) Notice: Subject to any disclaimer, the term of this patent is extended or adjusted under 35 U.S.C. 154(b) by 178 days.

(21) Appl. No.: 13/086,572

(22) Filed: Apr. 14, 2011

(65) Prior Publication Data

US 2011/0253378 A1 Oct. 20, 2011

(30) Foreign Application Priority Data

Apr. 14, 2010 (GB) ..... 1006158.8

(51) Int. Cl.
*E21B 7/12* (2006.01)

(52) U.S. Cl.
USPC ..... 166/344; 166/348; 166/368; 166/250.01; 166/373; 166/75.14

(58) Field of Classification Search
USPC ..... 166/344, 348, 368, 250.01, 373, 75.14
See application file for complete search history.

(56) References Cited

U.S. PATENT DOCUMENTS

| | | | | | |
|---|---|---|---|---|---|
| 3,360,048 | A | * | 12/1967 | Watkins | 166/319 |
| 3,955,623 | A | * | 5/1976 | Aumann | 166/340 |
| 4,325,409 | A | * | 4/1982 | Roberts | 137/596.14 |
| 4,325,434 | A | * | 4/1982 | Roberts | 166/321 |
| 4,333,526 | A | * | 6/1982 | Watkins | 166/72 |
| 4,449,583 | A | * | 5/1984 | Lawson | 166/72 |
| 4,512,406 | A | * | 4/1985 | Vann et al. | 166/297 |
| 4,529,038 | A | * | 7/1985 | Brieger | 166/312 |
| 4,804,044 | A | * | 2/1989 | Wesson et al. | 166/297 |
| 4,848,457 | A | * | 7/1989 | Lilley | 166/321 |
| 4,969,517 | A | * | 11/1990 | Valka et al. | 166/208 |
| 5,143,158 | A | * | 9/1992 | Watkins et al. | 166/344 |
| 5,145,006 | A | * | 9/1992 | June | 166/341 |
| 5,366,017 | A | | 11/1994 | Voss, Jr. | |
| 5,372,201 | A | | 12/1994 | Milberger | |
| 5,396,954 | A | * | 3/1995 | Brooks | 166/187 |
| 5,503,230 | A | * | 4/1996 | Osborne et al. | 166/344 |
| 5,687,794 | A | * | 11/1997 | Watkins et al. | 166/363 |

(Continued)

FOREIGN PATENT DOCUMENTS

| | | |
|---|---|---|
| GB | 2 364 538 | 1/2002 |
| GB | 2 376 485 | 12/2002 |

(Continued)

*Primary Examiner* — Matthew Buck
*Assistant Examiner* — Aaron Lembo
(74) *Attorney, Agent, or Firm* — Nixon & Vanderhye PC

(57) ABSTRACT

A subsea wellhead assembly includes a wellhead body which disposed to support an isolation sleeve for a production tree and to support below the isolation sleeve a production casing hanger for a production casing string. The body also supports a second casing string outside the production casing string whereby to form an annulus between the casing strings. The body includes a passageway which is in communication with the annulus near a lower end of the body and extends upwardly within the wall of the body towards the upper end of the body. A valve is accommodated in the upper part of the body and provides controlled communication between the passageway and a port which can be coupled to the isolation sleeve. The valve is controllable from a production tree in particular is moveable between an open position and a closed position in response to fluid pressure applied to the valve from a production tree by way of the isolation sleeve.

18 Claims, 4 Drawing Sheets

(56) References Cited

U.S. PATENT DOCUMENTS

| | | | | |
|---|---|---|---|---|
| 5,769,162 | A * | 6/1998 | Bartlett et al. | 166/87.1 |
| 5,775,427 | A * | 7/1998 | Skeels et al. | 166/344 |
| 5,868,203 | A * | 2/1999 | Cunningham | 166/344 |
| 6,062,314 | A | 5/2000 | Nobileau | |
| 6,216,785 | B1 * | 4/2001 | Achee et al. | 166/278 |
| 6,227,300 | B1 * | 5/2001 | Cunningham et al. | 166/339 |
| 6,408,947 | B1 * | 6/2002 | Cunningham et al. | 166/339 |
| 6,488,083 | B2 * | 12/2002 | Bartlett et al. | 166/87.1 |
| 6,497,277 | B2 * | 12/2002 | Cunningham et al. | 166/95.1 |
| 7,073,591 | B2 * | 7/2006 | Massie et al. | 166/348 |
| 7,096,956 | B2 * | 8/2006 | Reimert | 166/348 |
| 7,296,629 | B2 * | 11/2007 | Bartlett | 166/348 |
| RE43,262 | E * | 3/2012 | June | 166/368 |
| 2003/0121667 | A1 * | 7/2003 | Massie et al. | 166/344 |
| 2003/0127229 | A1 | 7/2003 | Buckle et al. | |
| 2005/0121199 | A1 | 6/2005 | Massie et al. | |

FOREIGN PATENT DOCUMENTS

| | | |
|---|---|---|
| GB | 2 395 736 | 8/2005 |
| GB | 2 422 161 | 7/2006 |
| WO | WO 2010/020742 | 2/2010 |
| WO | WO 2010/062652 | 6/2010 |

* cited by examiner

SUBSEA WELLHEAD PROVIDING CONTROLLED ACCESS TO A CASING ANNULUS

CROSS-REFERENCE TO RELATED APPLICATION

This application claims priority from GB patent application No. 1006158.8 filed Apr. 14, 2010, the entire contents of which application are hereby incorporated by reference.

TECHNICAL FIELD

This invention relates to subsea wellheads and in particular to a wellhead which provides controlled access to a casing annulus and in particular to an annulus between a production casing and a relatively outer casing, such annulus being usually called a 'B annulus'.

RELATED ART

The present exemplary embodiment is particularly concerned with a wellhead which has the ability to control access to a casing annulus, particularly the B annulus, from a production tree, i.e. a 'Christmas tree', for example by way of an isolation sleeve. As a result, monitoring, venting and injection of the annulus may all be achieved, as well as the ability to test that the annulus is closed before the Christmas tree is removed. Various proposals have been made for the monitoring of a casing annulus. An object of the present exemplary embodiment is to provide easily controlled access to the annulus, without requiring special adapters and avoiding unnecessary penetrations of the wellhead to the exterior.

BRIEF SUMMARY

The exemplary embodiment provides a subsea wellhead assembly including a wellhead body having a generally cylindrical wall defining an axial bore, the body being disposed to support within the bore a casing hanger for the support of a first casing string within a second casing string whereby to form an annulus between the casing strings, the body including a communication passageway which is in communication with said annulus near a lower end of the body and extends upwardly in said wall towards an upper end of the body, and a valve which is accommodated near the upper end of said body and is disposed, preferably under the control of a production tree, to control fluid passage through the communication passageway.

The valve is preferably controllable from the production tree by way of an isolation sleeve. The valve may be moveable between open and closed positions in response to fluid pressure applicable to the valve by way of said isolation sleeve. There may be including passages for the application of such fluid pressure, these passages extending within the body of the isolation sleeve.

The valve may control a port in the bore; this port may be in communication with the isolation sleeve. The valve may be moveable between an open position connecting the passageway and the port and a closed position blocking communication between the passageway and the port. There may be at least one biasing spring for urging the valve to the closed position.

The isolation sleeve may have an axially extending passage disposed for communication with the port in the bore. The valve may have a gallery for providing communication between the communication passageway and the port.

The valve may be a slide valve and the assembly may include a valve sleeve fitting within the bore and defining therewith a chamber in which the valve is disposed.

One example of the present invention will be described in detail with reference to the accompanying drawings

DETAILED DESCRIPTION

Figure 1:
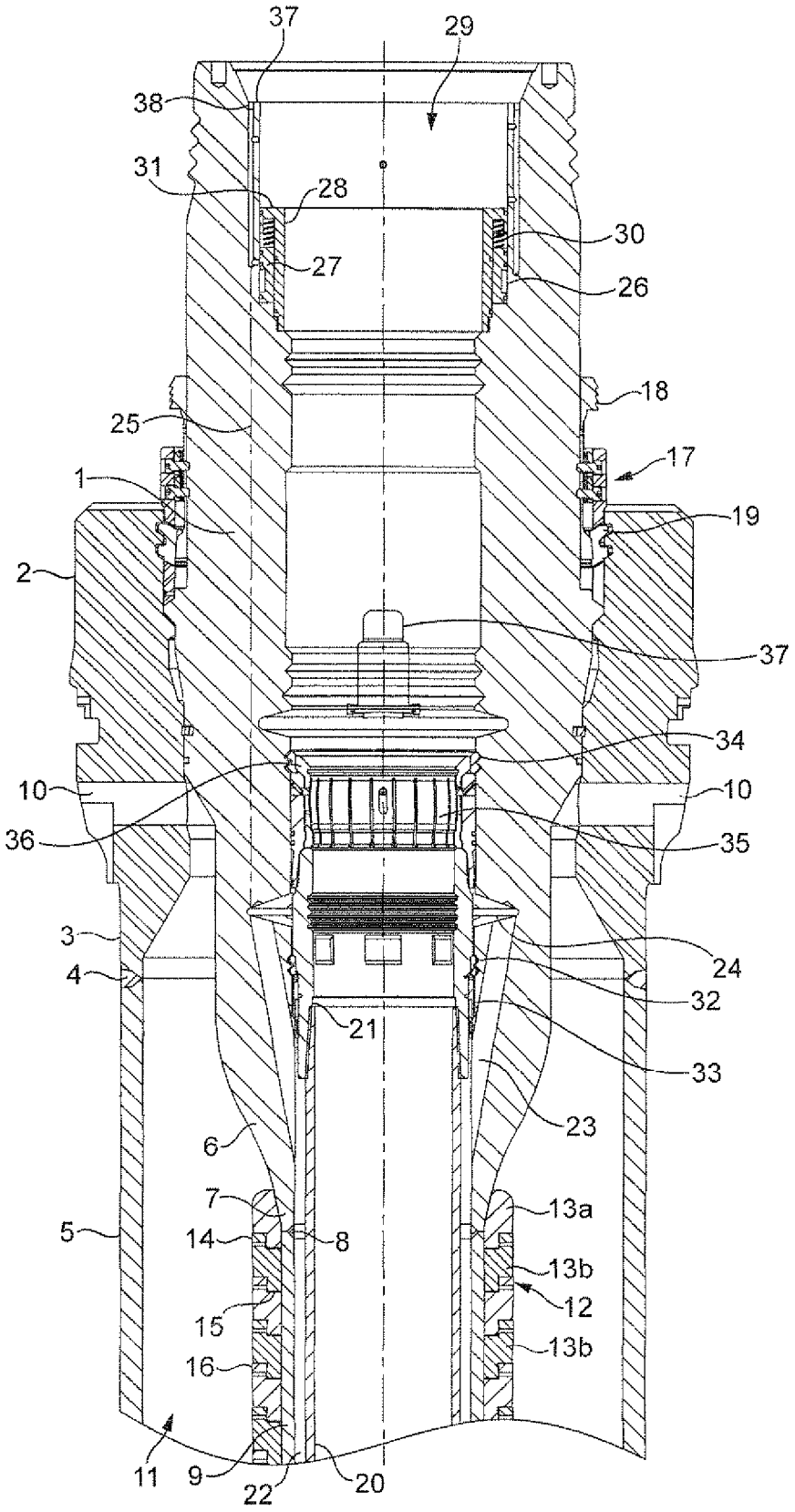
FIG. 1 is a sectional view of a wellhead according to the invention.

FIG. 1 illustrates in section a subsea wellhead assembly. The particular assembly illustrated is designed for use with a riser system of 13⅝ (346 mm) inside diameter within either a standard 30" (762 mm) or 36" (914.4 mm) diameter outer conductor. The comparatively slender bore through the wellhead allows a greater thickness for the wellhead than is usual. However, the invention is not necessarily limited to the stated dimensions of the riser system or other components.

The major components of the assembly are a generally cylindrical wellhead body 1 and a generally cylindrical conductor housing 2 within which the body 1 is received. The conductor housing 2 has a lower annular weld preparation profile 3 and, by means of a weld 4, supports an outer cylindrical conductor casing 5 that extends downwardly from the conductor housing 2 into a (pre-drilled) hole in the seabed (not shown).

The lower part 6 of the body 1 tapers inwardly to a slim weld preparation profile 7 abuts and, by means of a weld 8, supports a casing extension 9. In this example the casing extension 9 has an outside diameter of 14" (355.6 mm) and an inside diameter of 13⅝ (346 mm).

Typically the casing extension 9 extends down at least as far as the level of the seabed and preferably somewhat further. The conductor housing 2 has lateral vent ports 10 in communication with the annular space 11 between the outer conductor 5 and the casing extension 9.

A column of cement is formed in the space 11 between the outer conductor 5 and the casing extension 9 (and any casing components suspended from it). Cement is pumped down the well and rises up the annular space 11 up to at least the lower part 6 of the body 1.

Wellhead systems are exposed to cyclic forces which will, if great enough, lead to potential fatigue damage and integrity failure of all or part of the wellhead system. Cement on the outside of the wellhead extension will reduce the freedom for the extension to flex and so the repetitive stresses may be high enough for potential fatigue failure.

In this example the casing extension 9 is provided with a resilient sleeve 12 made of rubber of other suitable polymeric material. The sleeve preferably extends all the way round the extension and extends from the bottom 6 of the wellhead body 1 for a suitable distance part of, or all, the way down the casing extension 9. The thickness of the sleeve 12 needs to be selected such that it allows some flexure of the casing extension and allows sufficient circulation flow-by but does not prejudice the structural support that the extension requires.

The sleeve 12 is composed of a multiplicity of inter-fitting rings 13*a*, 13*b*. These rings, except for the uppermost ring 13*a*, each have an upper outer flange 14 and an inner lower flange 15 so that each upper flange 14 fits over a shoulder formed by the lower flange 15 on the adjacent upper ring. Each of the upper flanges 14 has a radial through-bore 16 which facilitates the close fitting of the rings 13. The rings thereby fit snugly together to form a substantially continuous resilient sleeve on the outside of the casing extension 9. The sleeve 12 may therefore be provided to any desired depth on the casing extension.

The conductor housing 2 is pre-tensioned by means of a tensioning device 17. This will not be described in detail because it preferably has a construction and manner of operation as described in GB patent No. 2393990 and U.S. Pat. No. 7,025,145 assigned to Aker Subsea Limited. Very briefly, movement of an operating member 18 causes outward oblique movement of a driving ring 19 and thereby tensioning of the body 1. The purpose of pre-tensioning is fully explained in the patents identified above.

Within the casing extension 9 is disposed a production casing 20 extending downwardly from and supported by a casing hanger 21. Various components associated with this casing hanger 21 are described in detail below. In this example the production casing has a 10.75" (273.05 mm) outside diameter.

The annular space 22 defined at its inner periphery by the production casing and at its outer periphery by the casing extension 9 (and the casing string depending therefrom) is usually called the 'B' annulus. It is desirable to monitor the pressure in the B annulus. Normally the B annulus is sealed by cement at its lower end and sealed by means of a 'pack-off' at the production casing hanger. Monitoring of the pressure within the B annulus enables the detection of for example a leak in a casing string. Such a leak is liable to cause collapse or other damage to the production casing.

Various techniques are known for providing access to the B annulus and the monitoring of its pressure by way of a production tree landed in the wellhead. They are generally complex and/or inconvenient to operate. The described wellhead provides a system in which an access to the B-annulus may be controlled by way of a production tree, avoiding penetration of the wellhead body to the exterior or valves in the casing hanger, special adapters and other complexities.

Extending obliquely upwardly from the inner surface of the lower part 6 of the wellhead body 1 are passages 23 in communication with an annular gallery 24. Although this gallery opens to the interior of the wellhead bore, it does so between upper and lower pack-offs associated with the casing hanger 21.

The system enables monitoring, venting and injection relative to the B annulus as well as the facility to test that the B annulus is closed before the production tree is removed.

Extending upwardly within the body 1 from the gallery 24 is a vertical passageway 25 (shown by a chain line in FIG. 1) which leads to an annular gallery 26 on the outside of a slide valve 27 disposed about a sleeve 28 that fits into the upper part of the bore 29 which extends axially through the wellhead body 1. The sleeve defines with the wall of the bore 29 a chamber for the valve 27. The valve 27 is biased to a closed (lower) position by means of one or more springs 30 between the top shoulder of the valve and a radial flange 31 of the sleeve 28.

The valve 27 can be moved between its open (upper) position and closed (lower) position by the application of fluid pressure either above or below the valve by way of passages not shown in FIG. 1. When the valve 27 is in its open position the vertical passageway 25 from the B annulus is in communication by way of the gallery 26 in the valve 27 with an isolation sleeve 39 (not shown in FIG. 1) disposed above the sleeve 28. The valve 27 and the sleeve 28 have lateral seals adjacent the inner wall of the bore 29. The operation of the valve will be described with reference to the later Figures.

As will be explained in greater detail later, the communication passage and the slide valve 27 allow the access to the B annulus 22 to be controlled from a production tree landed on the wellhead body 1 and in particular by way of the isolation sleeve.

The passageway 25 is a bore which extends from a shoulder 37 around the top aperture of the wellhead vertically through the body 1 to the gallery 24 which is in communication with the region of the B annulus 22. The passageway 25 can extend along and, as shown, entirely within the wall of the body in this manner owing to the comparative thickness of the wall and the comparatively slender bore of the wellhead. The passage 25 is blocked at its top 38 after it has been formed.

For the sake of completeness, there follows a brief description of the remaining features shown in FIG. 1.

The production casing hanger 21 carries a split ring 32 which is forced laterally into a recess in the bore when the production casing hanger is landed. The recess has oblique load bearing surfaces so that load can be transferred from the hanger 21 to the body 1. Below the ring 32 is a sleeve 33 landed on a shoulder in the bore 29.

The casing hanger 21 has an upper pack-off 34 which is forced into a profile in the bore by an activating sleeve 36. Within the sleeve 36 is a resilient barrel-shaped ring 35 which, in a manner not relevant to the present invention, aids the release of the pack-off from a running tool (not shown) and maintains the pack-off in position after it has been set in place.

Also shown in FIG. 1 is a slot 37 which allows by-pass of a tubing hanger (not shown) into the body 1 of the wellhead. This feature is not relevant to the claimed invention and will not be described further.

Figure 2:
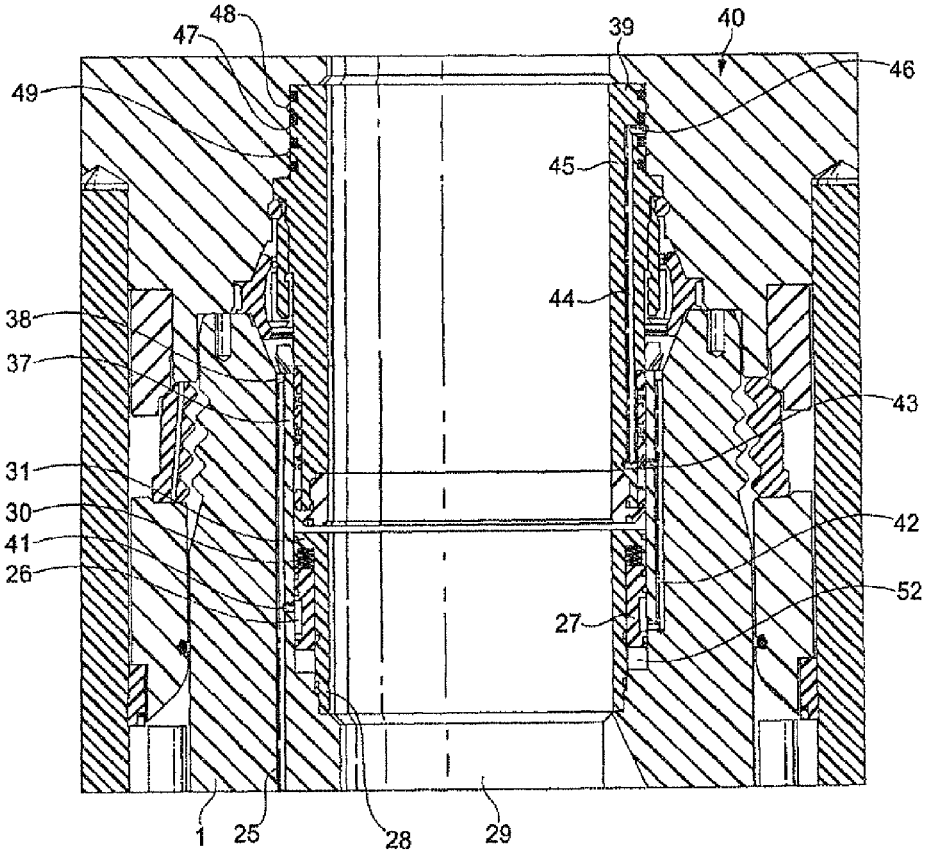
FIGS. 2 and 3 are truncated sectional views of the upper part of the wellhead, illustrating an assembly according to the invention in different phases of operation.
Figure 3:
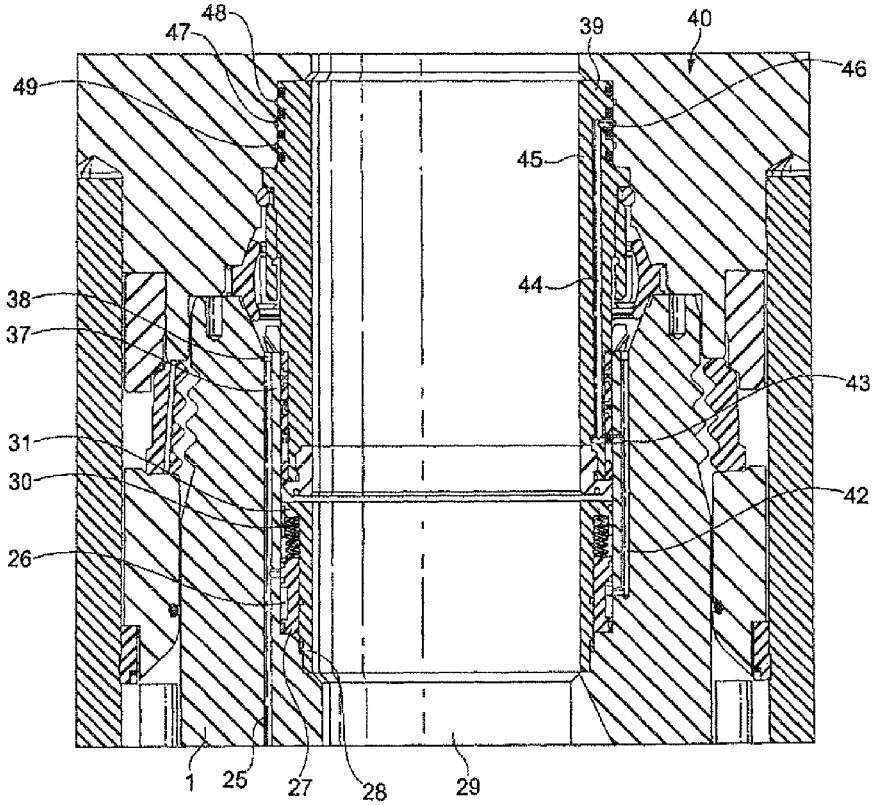
Figure 4:
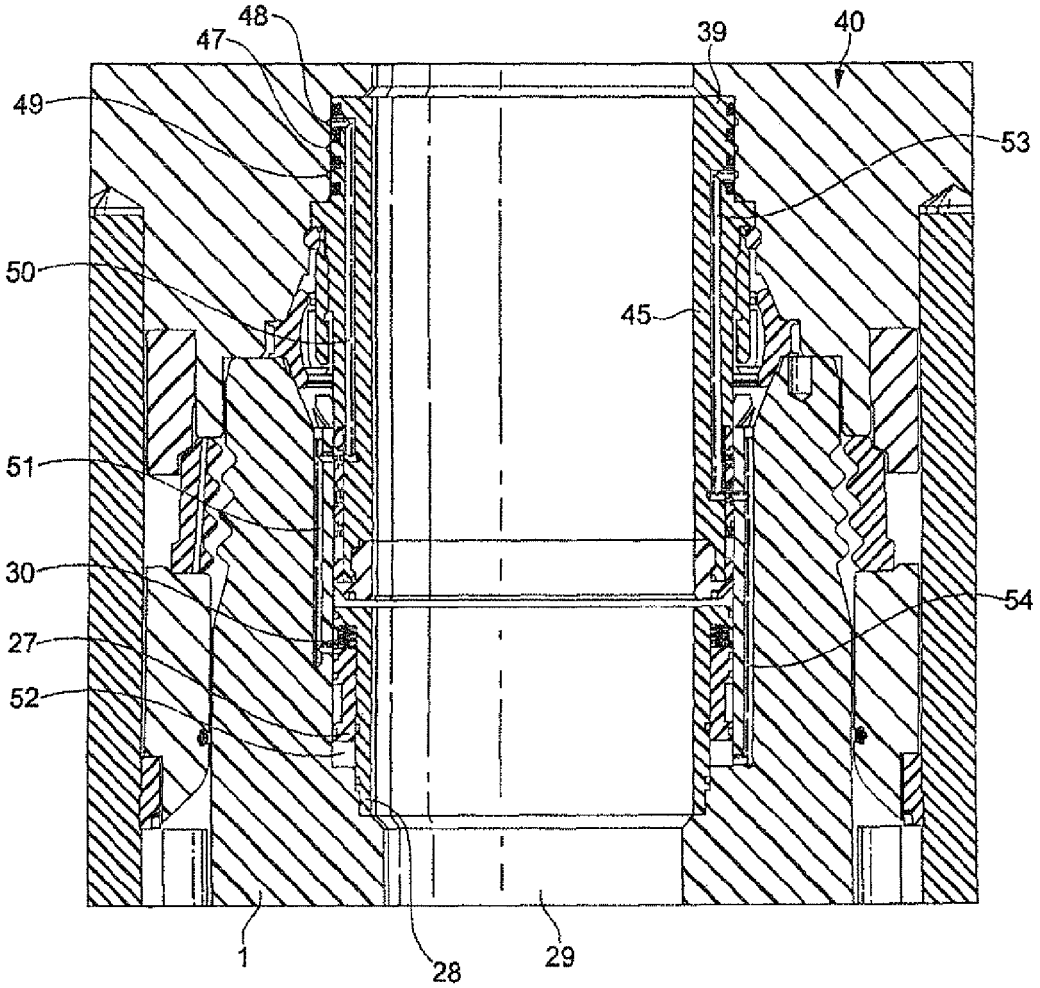
FIG. 4 is another truncated view of a different section of the assembly.

FIGS. 2 to 4 illustrate in greater detail the valve assembly for controlling access to the B annulus. They show an isolation sleeve 39 extending upwardly from the bore 29 and part of a tree 40. FIG. 2 particularly illustrates the valve 27 in its open position, FIG. 3 particularly illustrates the valve 27 in its closed position and FIG. 4 particularly illustrates the passages for the application of fluid (hydraulic) pressure for the operation of the valve.

As is shown in FIG. 2, the passageway 25 has a lateral port 41 to provide communication with the annular gallery 26 in the slide valve 27.

Also in communication with the gallery 26 is another passage 42 which is mainly formed as a vertical bore from the shoulder 37, and after formation is blocked at its top. The passage 42 has a lateral port 43 which is in communication with a passage 44 formed as a bore extending upwardly within the cylindrical wall 45 of the isolation sleeve 39 that fits into the bore 29 of the wellhead body 1. The passage communicates by way of a port 46 with an annular gallery 47. Thus communication, controlled by valve 27, with the tree can be established, for the purposes of monitoring, venting or injection of the B annulus as desired.

Above and below the gallery 47 are two other annular galleries 48 and 49, which can be coupled to sources of fluid, preferably hydraulic, pressure. The sources are controlled to apply fluid pressure by way of the isolation sleeve 39 to move the valve 27 between its open and closed positions.

FIG. 4 is a sectional view at right-angles to the views shown in FIGS. 2 and 3. A first passage 50 extends, from communication with gallery 48, within the wall 45 of the isolation sleeve 39 and communicates by way of a vertical passage 51 with the chamber 52 formed between the sleeve 28 and the bore 29. The passage 51 has a port into the chamber 52 at a location above the body of the valve 27. A second passage 53 extends from the gallery 49 vertically within the wall 45 of the isolation sleeve and communicates with a vertical passage 54 in the body 1. This passage 54 communicates with the chamber 52 at a location below the body of the valve 27.

Accordingly the valve 27 and the communication between the B annulus 22 and the port 43, and thence the isolation sleeve and the gallery 47, can be controlled by the production tree. Control otherwise than by way of fluid pressure may be provided but is not preferred.

The springs 30 bias the valve 27 to its closed position, in which the body of the valve blocks the port from passageway 25, so that the access to the B-annulus remains closed when the isolation sleeve 39 is removed.

The invention has been particularly described in relation to the provision of controlled access to the B annulus. However, the invention in its broad aspects may have utility in the provision of such access between another annulus between casing strings and the isolation sleeve, or the port 43 near the top of the bore 29 if the isolation sleeve be not present.

What is claimed is:

1. A subsea wellhead assembly including:

a wellhead housing having a generally cylindrical wall configured to support an outer casing string, and further defining an axial bore, the wellhead housing being disposed to support within said bore a casing hanger for the support of an inner casing string within said outer casing string whereby to form a monitoring annulus between the inner and outer casing strings, the wellhead housing including within said wall thereof a communication passageway which is in communication with said monitoring annulus near a lower end of the wellhead housing and which extends upwardly in said wall of the wellhead housing towards an upper end of the wellhead housing; and a valve which is accommodated near the upper end of said wellhead housing and disposed for control from a production tree to control fluid flow passage between (a) the monitoring annulus through said communication passageway within the wellhead housing wall and (b) the production tree while the production tree is in place.

2. The subsea wellhead assembly of claim 1 in which said valve is controllable from the production tree by way of an isolation sleeve.

3. The subsea wellhead assembly of claim 2, in which said valve is moveable between open and closed positions in response to fluid pressure applicable to the valve by way of said isolation sleeve.

4. The subsea wellhead assembly of claim 3 and including passages for the application of said fluid pressure, extending within a body of said isolation sleeve.

5. The subsea wellhead assembly of claim 2, in which said valve controls a port in communication with a passage in said isolation sleeve.

6. The subsea wellhead assembly of claim 5, in which said valve is moveable between an open position connecting said passageway and said port and a closed position blocking communication between said passageway and said port.

7. The subsea wellhead assembly of claim 6, and including at least one biasing spring for urging said valve to said closed position.

8. The subsea wellhead assembly of claim 5, in which said passage in said isolation sleeve communicates with a gallery in said production tree.

9. The subsea wellhead assembly of claim 5, in which said valve has a gallery providing communication between said communication passageway and said port.

10. The subsea wellhead assembly of claim 1, in which said valve is a slide valve and the assembly includes a valve sleeve fitting within said bore and defining therewith a chamber in which said valve is disposed.

11. A subsea wellhead assembly including:

a wellhead housing having a generally cylindrical wall configured to support an outer casing string and further disposed to support a casing hanger for the support of an inner casing string within said outer casing string to form a monitoring annulus between the inner and outer casing strings;

said wellhead housing being disposed to support an isolation sleeve for a production tree and including a passageway within said wall of the wellhead housing in communication near a lower end of the wellhead housing with said monitoring annulus between casing strings and extending upwardly within said wall of the wellhead housing to an upper end of the wellhead housing to provide communication between the isolation sleeve and said monitoring annulus between inner and outer casing strings; and a valve which controls communication through said passageway and is operable between open and closed positions by means of fluid pressure applied to the valve by way of said isolation sleeve.

12. The subsea wellhead assembly of claim 11, in which said isolation sleeve has passages for the application of said fluid pressure, these passages extending within a body wall of the isolation sleeve.

13. The subsea wellhead assembly of claim 11 wherein said valve is accommodated in said wellhead housing below said isolation sleeve and provides controlled communication between said passageway and a passage in said isolation sleeve.

14. A subsea wellhead assembly including:

a wellhead housing having a generally cylindrical wall configured to support an outer casing string, and further defining an axial bore, the wellhead housing being disposed to support within the bore a casing hanger for the support of an inner casing string within said outer casing string to form a monitoring annulus between the inner and outer casing strings, wherein:

said wellhead housing includes a communication passageway within said wall of the wellhead housing which is in communication with said monitoring annulus near a lower end of the wellhead housing and extends upwardly and entirely within said wall of the wellhead housing to an upper end of the wellhead housing;

said wellhead housing includes a port in said bore; and a valve is accommodated near the upper end of said wellhead housing and is disposed to control fluid communication between said passageway and said port.

15. The subsea wellhead assembly of claim 14 in which said valve comprises a slide valve which is moveable between an open position connecting said passageway and said isolation sleeve and a closed position blocking communication between said passageway and said isolation sleeve.

16. The subsea wellhead assembly of claim 15 and including a spring bias for urging said valve to said closed position.

17. The subsea wellhead assembly of claim 14, and further comprising an isolation sleeve for a production tree, said isolation sleeve being disposed in said bore at the upper end thereof, wherein said isolation sleeve includes a passageway for fluid communication between said port and said production tree.

18. The subsea wellhead assembly of claim 17, in which said isolation sleeve is disposed to communicate fluid pressure from said tree to operate said valve.

* * * * *